US008875812B2

(12) United States Patent
Setlur et al.

(10) Patent No.: US 8,875,812 B2
(45) Date of Patent: Nov. 4, 2014

(54) POLYCRYSTALLINE DIAMOND CUTTING ELEMENT AND METHOD OF USING SAME

(75) Inventors: Deepthi Raj Setlur, Cypress, TX (US); John Christopher Troncoso, Houston, TX (US); Michael D. Hughes, Conroe, TX (US)

(73) Assignee: National Oilwell DHT, L.P., Houston, TX (US)

( * ) Notice: Subject to any disclaimer, the term of this patent is extended or adjusted under 35 U.S.C. 154(b) by 496 days.

(21) Appl. No.: 13/189,309

(22) Filed: Jul. 22, 2011

(65) Prior Publication Data

US 2012/0018223 A1 Jan. 26, 2012

Related U.S. Application Data

(60) Provisional application No. 61/367,026, filed on Jul. 23, 2010.

(51) Int. Cl.

| | |
|---|---|
| ***E21B 10/46*** | (2006.01) |
| ***E21B 10/573*** | (2006.01) |
| ***B22F 7/08*** | (2006.01) |
| ***C22C 26/00*** | (2006.01) |
| *B22F 5/00* | (2006.01) |

(52) U.S. Cl.

CPC ..... *E21B 10/5735* (2013.01); *B22F 2005/001* (2013.01); *B22F 7/08* (2013.01); *C22C 26/00* (2013.01)

USPC ..... 175/379; 175/434

(58) Field of Classification Search

CPC ..... E21B 10/006; E21B 10/5676

USPC ..... 175/379, 432, 434, 435; 76/108.2, 76/108.4

See application file for complete search history.

(56) References Cited

U.S. PATENT DOCUMENTS

| | | | |
|---|---|---|---|
| 3,141,746 | A | 7/1964 | Lai |
| 4,109,737 | A | 8/1978 | Bovenkerk |
| 4,200,159 | A | 4/1980 | Peschel et al. |
| 4,324,300 | A | 4/1982 | Logan, Jr. |
| 4,478,298 | A | 10/1984 | Hake et al. |
| 4,525,179 | A | 6/1985 | Gigl |

(Continued)

FOREIGN PATENT DOCUMENTS

| | | |
|---|---|---|
| CN | 101608533 | 12/2009 |
| CN | 101713280 | 5/2010 |

(Continued)

OTHER PUBLICATIONS

International Preliminary Report on Patentability and Written Opinion for PCT Patent Application No. PCT/US2011/045100 dated Jan. 29, 2013, 6 pages.

(Continued)

*Primary Examiner* — Kenneth L Thompson

(74) *Attorney, Agent, or Firm* — JL Salazar Law Firm

(57) ABSTRACT

A polycrystalline diamond cutting (PDC) element of a drill bit of a downhole drilling tool is provided. The PDC element having a substrate, a diamond table and at least one pattern. The diamond table has an initial cutting edge along a periphery thereof. The pattern integrally formed within the diamond table. The pattern(s) defining at least one discontinuity about the diamond table that, in operation, selectively breaks away upon impact to create new cutting edges in the diamond table whereby a sharp cutting edge is continuously exposed to a material being cut.

20 Claims, 5 Drawing Sheets

(56) References Cited

U.S. PATENT DOCUMENTS

| | | | | | |
|---|---|---|---|---|---|
| 4,629,373 | A | | 12/1986 | Hall | |
| 4,784,023 | A | | 11/1988 | Dennis | |
| 4,844,185 | A | | 7/1989 | Newton, Jr. et al. | |
| 4,869,330 | A | | 9/1989 | Tibbitts | |
| 4,898,252 | A | | 2/1990 | Barr | |
| 5,054,246 | A | | 10/1991 | Phaal et al. | |
| 5,301,762 | A | | 4/1994 | Besson | |
| 5,351,772 | A | | 10/1994 | Smith | |
| 5,355,969 | A | * | 10/1994 | Hardy et al. | 175/432 |
| 5,469,927 | A | * | 11/1995 | Griffin | 175/432 |
| 5,776,615 | A | | 7/1998 | Wong et al. | |
| 6,009,963 | A | * | 1/2000 | Chaves et al. | 175/432 |
| 6,026,919 | A | * | 2/2000 | Thigpen et al. | 175/432 |
| 6,544,308 | B2 | | 4/2003 | Griffin et al. | |
| 6,592,985 | B2 | | 7/2003 | Griffin et al. | |
| 6,601,662 | B2 | | 8/2003 | Matthias et al. | |
| 7,594,553 | B2 | * | 9/2009 | Tank et al. | 175/379 |
| 7,694,757 | B2 | * | 4/2010 | Keshavan | 175/434 |
| 7,753,143 | B1 | | 7/2010 | Miess et al. | |
| 7,757,791 | B2 | | 7/2010 | Belnap et al. | |
| 7,874,383 | B1 | | 1/2011 | Cannon et al. | |
| 8,061,454 | B2 | * | 11/2011 | Voronin et al. | 175/426 |
| 8,109,350 | B2 | * | 2/2012 | Fang et al. | 175/434 |
| 8,267,204 | B2 | * | 9/2012 | Lyons | 175/432 |
| 8,540,037 | B2 | * | 9/2013 | Hall | 175/433 |
| 2004/0007393 | A1 | * | 1/2004 | Griffin | 175/434 |
| 2009/0133938 | A1 | * | 5/2009 | Hall et al. | 175/434 |
| 2010/0012389 | A1 | * | 1/2010 | Zhang et al. | 175/432 |
| 2010/0014931 | A1 | | 1/2010 | Matthias | |
| 2010/0200305 | A1 | * | 8/2010 | Griffin et al. | 175/434 |
| 2013/0000992 | A1 | * | 1/2013 | DiGiovanni | 175/432 |

FOREIGN PATENT DOCUMENTS

| | | |
|---|---|---|
| EP | 0071036 | 2/1983 |
| WO | 00/36264 | 6/2000 |
| WO | 0036264 | 6/2000 |

OTHER PUBLICATIONS

International Search Report for PCT Patent Application No. PCT/US2011/045100 dated Oct. 12, 2012, 4 pages.

First Chinese Office Action for CN Patent Application No. 201180043594.9 dated Jun. 25, 2014, 21 pages.

* cited by examiner

POLYCRYSTALLINE DIAMOND CUTTING ELEMENT AND METHOD OF USING SAME

CROSS REFERENCE TO RELATED APPLICATIONS

This application claims the benefit of U.S. Provisional Patent Application Ser. No. 61/367,026 filed on Jul. 23, 2010, the entire contents of which is hereby incorporated by reference.

BACKGROUND OF THE INVENTION

1. Field of the Invention

The techniques herein relate to wellsite operations. More particularly, techniques herein relate to a polycrystalline diamond cutting (PDC) element usable, for example, in earth boring drill bits for mineral exploration, and particularly for oil and natural gas.

2. Description of the Related Art

Polycrystalline diamond and polycrystalline diamond-like elements are known, for the purposes of this specification, as PDC elements. PDC elements are typically formed from carbon based materials. Another somewhat similar diamond-like material is known as carbonitride (CN) as described in U.S. Pat. No. 5,776,615.

PDC elements are typically formed from a mix of materials processed under high-temperature and high-pressure into a polycrystalline matrix of bonded diamond crystals. PDC elements may be manufactured in a process which uses catalyzing materials during their formation. These catalyzing materials may form a residue which may impose a limit upon the maximum useful operating temperature of a PDC element while in service.

One manufactured form of a PDC element may be a two-layer or multi-layer PDC element where a facing table of polycrystalline diamond material is integrally bonded to a substrate of less hard material, such as cemented tungsten carbide. The PDC element may be in the form of a circular or part-circular tablet, or it may be formed into other shapes suitable for drilling applications or for other applications, such as friction bearings, valve surfaces, indenters, tool mandrels, etc. PDC elements of this type may be used for a wide range of applications where a hard wear and erosion resistant material may be required. PDC elements may also find particular usage in earth boring drill bits, where the substrate of the PDC element may or may not be brazed to a carrier, and this carrier may also typically be cemented tungsten carbide. This configuration for PDC elements may be used in fixed cutter or rolling cutter earth boring bits. These PDC elements may be received in a socket of the drill bit, brazed on a face of the drill bit, or infiltrated in a body of a 'matrix' type drill bit. PDC elements may also be fixed to a post in a machine tool for use in machining various non-ferrous materials.

PDC elements may be formed by sintering diamond powder with a suitable binder-catalyzing material in a high-pressure, high-temperature press. Techniques for forming PDC elements are described, for example, in U.S. Pat. No. 3,141,746. In one process for manufacturing PDC elements, diamond powder is applied to the surface of a preformed tungsten carbide substrate incorporating cobalt. The assembly is then subjected to very high temperature and very high pressure in a press. During this process, cobalt migrates from the substrate into the diamond layer (or table) and acts as a binder-catalyzing material, causing the diamond particles to bond to one another with diamond-to-diamond bonding, and also causing the diamond layer to bond to the substrate.

The completed PDC element may have at least one body with a matrix of diamond crystals bonded to each other with many interstices containing a binder-catalyzing material as described above. The diamond crystals may have a first continuous matrix of diamond, with the interstices forming a second continuous matrix of interstices containing the binder-catalyzing material. In addition, there may be a relatively few areas where the diamond-to-diamond growth has encapsulated some of the binder-catalyzing material. These 'islands' may not be part of the continuous interstitial matrix of binder-catalyzing material.

In one form, the diamond body may have from about 85% to about 95% of diamond by volume and the binder-catalyzing material may have the other about 5% to about 15% diamond. Such a PDC element may be subject to thermal degradation due to differential thermal expansion between the interstitial cobalt binder-catalyzing material and diamond matrix beginning at temperatures of about 400 degrees C. Upon sufficient expansion, the diamond-to-diamond bonding may be ruptured and cracks and chips may occur.

When used in highly abrasive cutting applications, such as in drill bits, these PDC elements may typically wear or fracture, and there has been a relationship observed between wear resistance of the PDC elements and their impact strength. This relationship may be attributed to the catalyzing material remaining in the interstitial regions among the bonded diamond crystals which contributes to the thermal degradation of the diamond layer.

A portion of this catalyzing material may be preferentially removed from a portion of the working surface in order to form a surface with much higher abrasion resistance without substantially reducing its impact strength. Examples of such PDC elements designed for increased strength characteristic are described in U.S. Pat. Nos. 6,601,662; 6,592,985 and 6,544,308.

Certain types of PDC elements (e.g., diamond structures) may form protruding lips as the cutter drills. These lips may repeatedly form and then break off as the cutter drills into the earth, so as to always present a sharp cutting edge to the formation. However, a certain amount of wear may occur in the cutting element to form the lips.

Various types of PDC elements have become widely used in the oilfield drilling industry over time, and attempts have been made to increase the cutting efficiency of these PDC elements. However, the drilling market has remained competitive and calls for ever higher drilling rates of penetration. The techniques provided herein are designed to provide these and other capabilities.

SUMMARY OF THE INVENTION

Disclosed herein is a polycrystalline diamond cutting element for a borehole drilling downhole drill bit tool that has a substrate with a diamond table. The diamond table has an initial cutting edge along a periphery thereof; and at least one pattern integrally formed within the diamond table. The pattern defines at least one discontinuity about the diamond table that, in operation, selectively breaks away upon impact to create new cutting edges in the diamond table whereby a sharp cutting edge is continuously exposed to a material being cut.

The polycrystalline diamond cutting element may have a discontinuity that is formed along the initial cutting edge within the diamond table that reacts to operating loads to direct shearing forces into the diamond table to fracture the initial cutting edge and to form the new cutting edges. Furthermore, the polycrystalline diamond cutting element may have at least one pattern that is a mesh pattern.

The above polycrystalline diamond cutting element may also have a honeycomb pattern, where the pattern is sintered together with the diamond table and the substrate under conditions of ultra high temperatures and pressures, this may also include a polycrystalline diamond grit, and the substrate may have a tungsten carbide substrate. Furthermore, the polycrystalline diamond cutting element may have at least one discontinuity that is a fracture surface along the initial cutting edge. The discontinuity may reside close to the initial cutting edge and follow an edge geometry of the diamond table.

In addition, the diamond table of the above polycrystalline diamond cutting element may wear over time such that the at least one pattern is exposed upon wear and/or impact damage to the initial cutting edge of the diamond table.

The above polycrystalline diamond cutting element may also have a diamond table that wears quickly, such that the at least one pattern wears away quickly to expose a controlled geometry of the new cutting edges, thereby reducing loss of the diamond table on subsequent impacts.

The polycrystalline diamond cutting element may also have at least one pattern that is one of a snowflake configuration, a ring configuration, a plate configuration, a perforated configuration and combinations thereof, and the pattern may be a plurality of patterns, each having an additional discontinuity parallel to a top surface of the diamond table. One of the patterns may have an angled periphery positionable about the cutting edge. The pattern may be made of tungsten carbide, and/or scattered pellets of aggregated carbon nano-rods.

In addition a polycrystalline diamond cutting element for a drill bit of a downhole drilling tool is described that is made up of a substrate, a diamond table positionable on the substrate. The diamond table may have an initial cutting edge along a periphery thereof; and at least one pattern within the diamond table. The at least one pattern may comprise a discontinuity defining a plane of weakness within the diamond table that, in operation, selectively breaks away along the plane of weakness to continuously expose fracture surfaces in the diamond table whereby a sharp cutting edge is continuously exposed to a material being cut.

This polycrystalline diamond cutting element may have at least one discontinuity along the initial cutting edge which creates a fracture surface allowing exposure of a new cutting edge to the material being cut. In addition, the at least one pattern may have a periphery defining an angle of a chamfer that creates a fault line in the diamond table which is controlled by an angle of a mesh of the at least one pattern.

Also disclosed is a method of drilling downhole with a drill bit by positioning a plurality of polycrystalline diamond cutting elements on the drill bit, each of the plurality of polycrystalline diamond cutting elements having a substrate, a diamond table positionable on the substrate, the diamond table having an initial cutting edge along a periphery thereof; and at least one pattern integrally formed within the diamond table. The pattern may define at least one discontinuity on the diamond table that may continuously expose a sharp cutting edge by selectively breaking away portions of the diamond table upon impact to create a new cutting edge in the diamond table as the drill bit is advanced into the earth.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are, therefore, not to be considered limiting of its scope. The figures are not necessarily to scale, and certain features and certain views of the figures may be shown exaggerated in scale or in schematic in the interest of clarity and conciseness.

DETAILED DESCRIPTION OF THE INVENTION

The description that follows includes exemplary apparatuses, methods, techniques, and instruction sequences that embody techniques of the inventive subject matter. However, it is understood that the described embodiments may be practiced without these specific details.

The techniques described herein relate to a polycrystalline diamond cutting (PDC) element configured to remain sharp during drilling. The PDC element may be provided with discontinuities which are able to selectively break off to continuously provide a sharp edge. Such features may be used to enhance drilling operations by, for example, increasing rates of penetration, reducing wear, enhancing drilling, etc. The cutting efficiency of a PDC element for an earth boring drill bit may also be influenced by the cutting edge preparation on the PDC elements. Maintaining a sharp edge through the length of a run may be important to improving the overall drilling efficiency of the drill bit.

Figure 1:
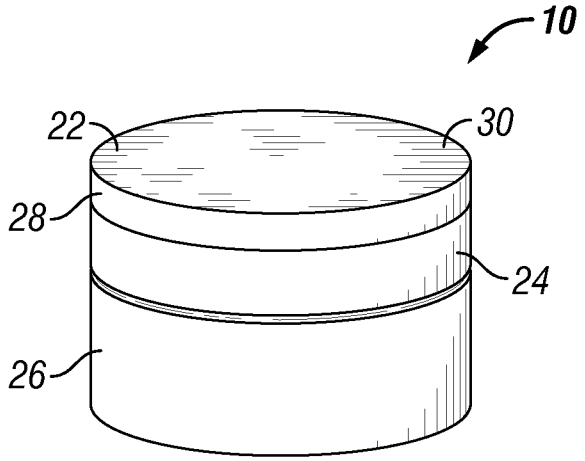
FIG. 1 is a perspective view of a PDC element of the invention.
Figure 2:
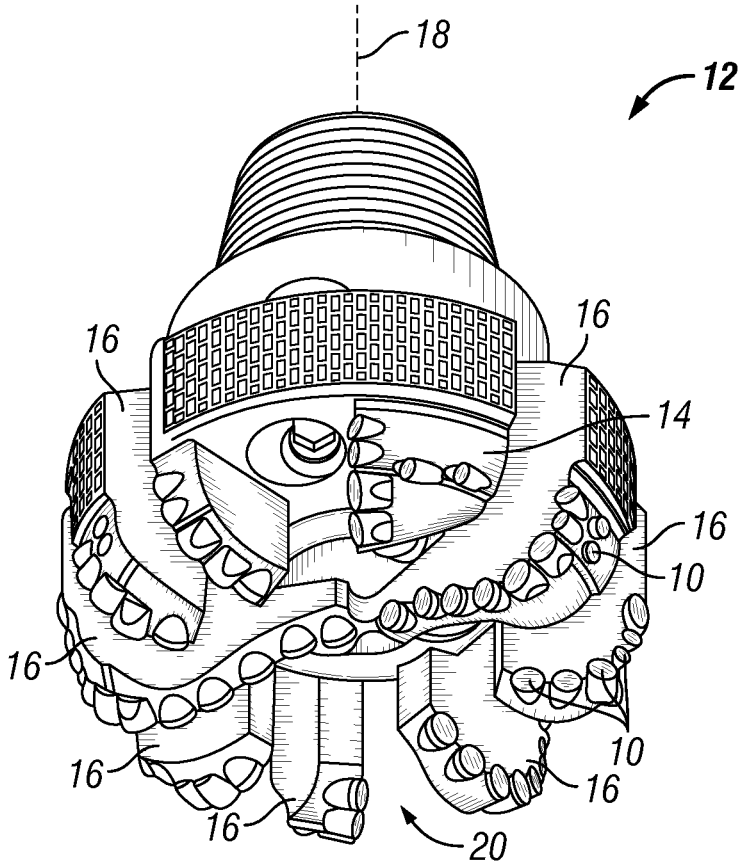
FIG. 2 is a perspective view of an earth boring drill bit having the cutting elements of FIG. 1.

Referring now to FIGS. 1 and 2, the PDC element 10 of the present invention may be a preform cutting element for a fixed cutter rotary drill bit 12 (as shown in FIG. 2). The bit body 14 of the drill bit 12 may be formed with a plurality of blades 16 extending generally outwardly away from the central longitudinal axis of rotation 18 of the drill bit 12. Spaced apart side-by-side along a leading face 20 of each blade 16 is a plurality of the PDC elements 10 of the invention.

Typically, the PDC element 10 has a body in the form of a cylindrical tablet having a thin front facing diamond layer (or table) 22, and a substrate 24. The diamond table 22 may be bonded in a high-pressure, high-temperature press to a substrate 24 of a less hard material, such as cemented tungsten carbide or other metallic material. The PDC element 10 may be preformed and then may be bonded onto a generally cylindrical carrier 26, which may also be formed from cemented tungsten carbide. Alternatively, PDC element 10 may be attached directly to the blade(s) 16. The PDC element 10 has peripheral working surface 28 and end working surface 30 which, as illustrated, may be substantially perpendicular to one another. The working surfaces 28 and 30 may also be at other suitable angles.

The cylindrical carrier 26 may be received within a correspondingly shaped socket or recess in the blade 16. The carrier 26 may be brazed, shrink fit, press fit or otherwise secured into the socket. Where brazed, the braze joint may extend over the carrier 26 and part of the substrate 24. In operation, the fixed cutter drill bit 12 is rotated and weight is applied. This forces the PDC elements 10 into the earth being drilled, effecting a cutting and/or drilling action.

Shown in FIGS. 3-8 are various PDC elements 10 that have intentionally introduced regions of relative strength and weaknesses in the general form of discontinuities 40*a-d,a*' which are formed about the working surfaces 28, 30 of diamond table 22. The discontinuities 40*a-d,a*' are geometrically oriented non-diamond structures embedded within or formed upon the diamond table 22. These discontinuities 40*a-d, a*' may form 'fault plane weaknesses' as will be described further herein.

In operation, the cutting action of the PDC elements 10 may be dependent upon the geometry of a cutting edge 50 along a periphery of each of these PDC elements 10. The cutting edge 50 is continuously renewed during operation by exposing and selectively failing along these discontinuities 40*a-d,a*' within the PDC elements 10 to maintain a sharp cutting edge 50.

Figure 4A:
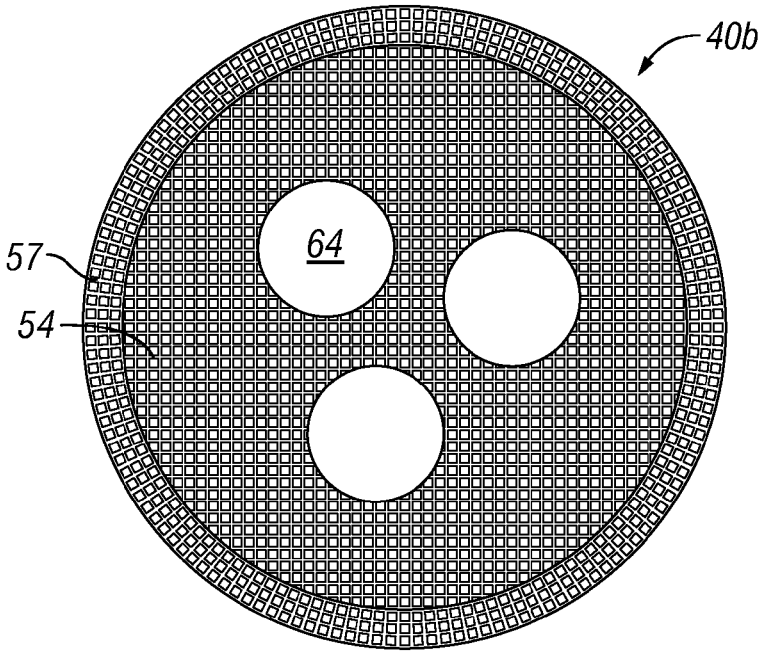
FIG. 4A is top view of a discontinuity having a 'perforated' configuration.
Figure 4B:
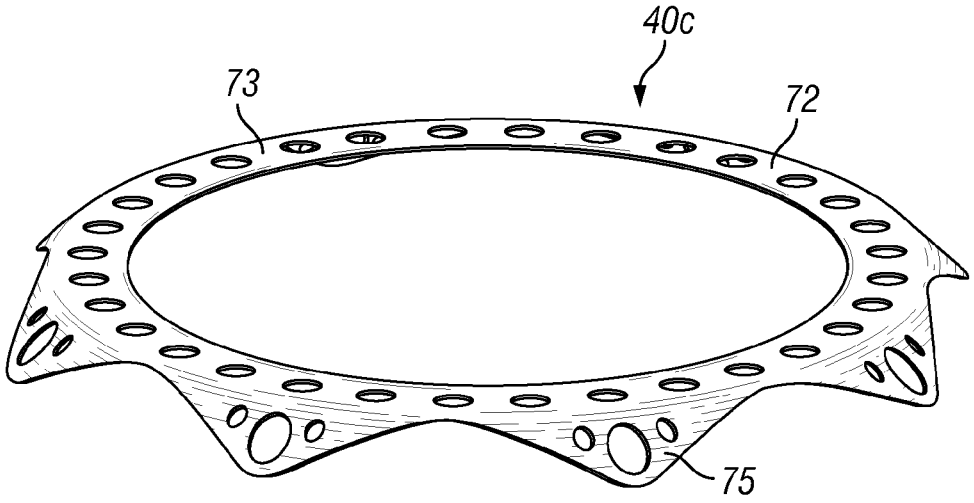
FIG. 4B is a perspective view of a discontinuity having a 'snowflake' configuration.
Figure 4C:
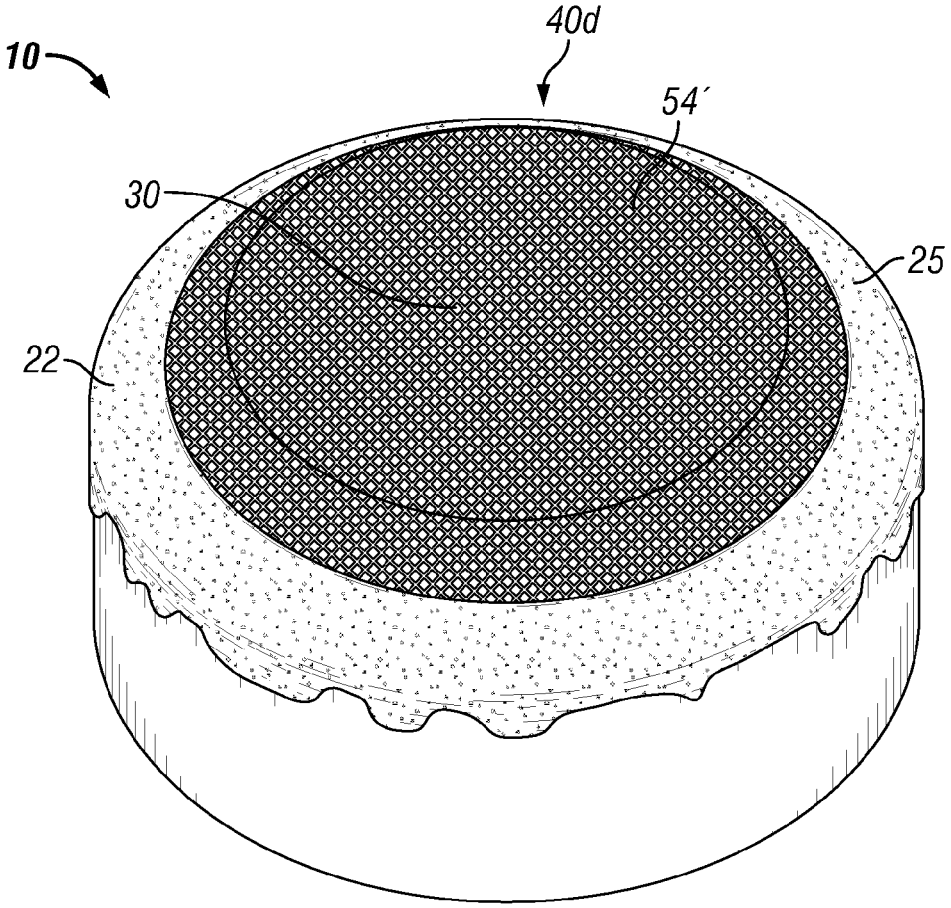
FIG. 4C is a perspective cutaway view of a PDC element having a discontinuity with a 'plate' configuration.

The discontinuities 40*a-d, a*' within the PDC elements 10 may be manufactured by providing within the diamond layer 22 of the preform PDC element 10, a discontinuity 40*a-d,a*' with regular geometry, such as a honeycomb pattern (as is shown in FIG. 4B), or a sieve or mesh pattern (as shown in FIGS. 4A and 4C), or any one of numerous other patterns. The discontinuities 40*a-d, a*' may also be perforated and/or stamped in a separate operation or may be formed simultaneously with the PDC element 10. These discontinuities 40*a-d,a*' may preferably be made of a suitable material such as tungsten carbide formed in a wire mesh, although numerous other materials and geometrical configurations may also be suitable. Other metallic materials for the discontinuities 40*a-d, a*' may be suitable provided that they are compatible with the other materials in the diamond table 22.

These discontinuities 40*a-d, a*' may produce areas of varying wear resistance and impact strength in the finished PDC element 10 and, therefore, provide for a self sharpening effect when in operation by allowing select chipping or wearing of the element 10 along these discontinuities 40*a-d*, a'. The open nature of the honeycomb pattern shown in FIG. 4B or the mesh pattern in FIGS. 4A and 4C allow the diamond layer to completely entomb the mesh pattern and thereby control how much diamond material is 'chipped away' under any particular set of drilling conditions.

The preform PDC elements 10 with the introduced discontinuities 40*a-d, a*' may be made by sintering in a high temperature, high pressure process together with the polycrystalline diamond grit and a tungsten carbide substrate. Discontinuities that are formed along the cutting edge 50 within the diamond table 22 may react to operating loads to direct shearing forces into the PDC element 10 to fracture the existing polycrystalline diamond table 22 at the cutting edge 50 and to form a new cutting edge from the existing cutting edge 50 as the PDC element 10 is operated.

The discontinuities 40*a-d, a*' define 'fault plane' weaknesses as illustrated in FIGS. 3-8. In these figures the 'fault plane' weaknesses are aligned to be generally parallel to the top surface 30 of the cutting element. In FIGS. 4B, 4C, 6, and 8, portions of the 'fault plane' weaknesses are not necessarily parallel to the top surface 30 of the cutting element 10. The 'fault plane' weaknesses may also be defined (e.g., made and orientated) so that they will tend to fracture simultaneously. However, it is also possible to have the stacked 'fault plane' weaknesses arranged such they are not aligned, as illustrated in, for example, FIG. 4B.

Figure 3:
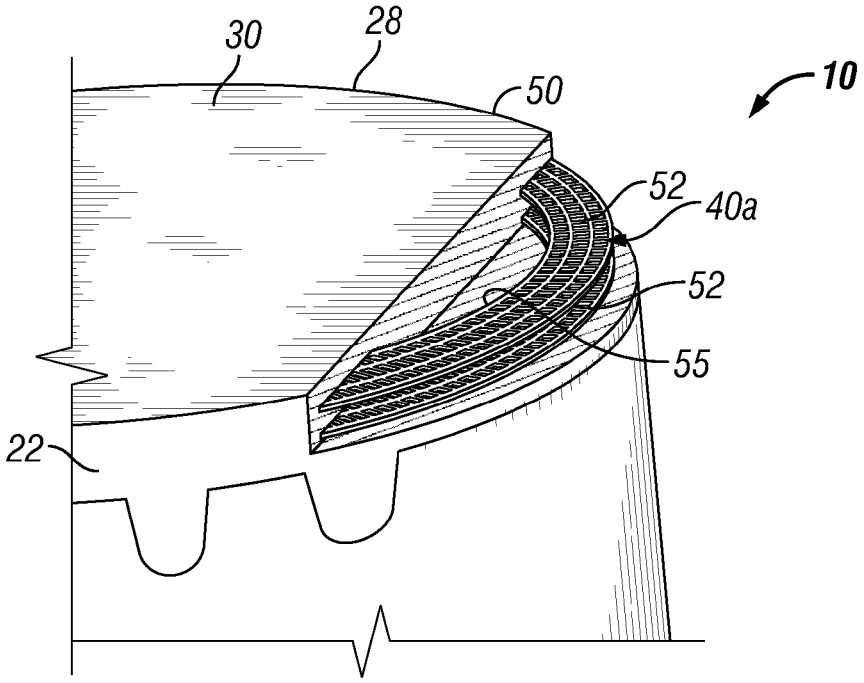
FIG. 3 is a partial cutaway perspective view of a PDC element having two discontinuities with a 'ring' configuration substantially parallel to a top surface of the PDC element.

Referring now to FIG. 3, the discontinuity 40*a* is depicted as a mesh pattern 52 in the shape of a ring and defining areas of weaknesses within the PDC element 10. FIG. 3 is a partial cutaway top view a cutting element 10 showing two sets of discontinuities 40*a* defining a 'fault plane' weakness therein. The fault plane weakness runs substantially parallel to a top surface 30 of the PDC element. Each sets of discontinuities 40*a* is characterized as a segment of a 'fault plane' running within a diamond table 22 substantially parallel to the top surface 30 and out to the cutting edge 50 of the PDC element 10. The mesh pattern 52 is depicted as having a hole 55 therethrough. As shown, multiple parts may be used to create multiple, stacked 'fault plane' weaknesses defined by the mesh pattern 52 as the PDC element 10 wears in operation.

Figure 5:
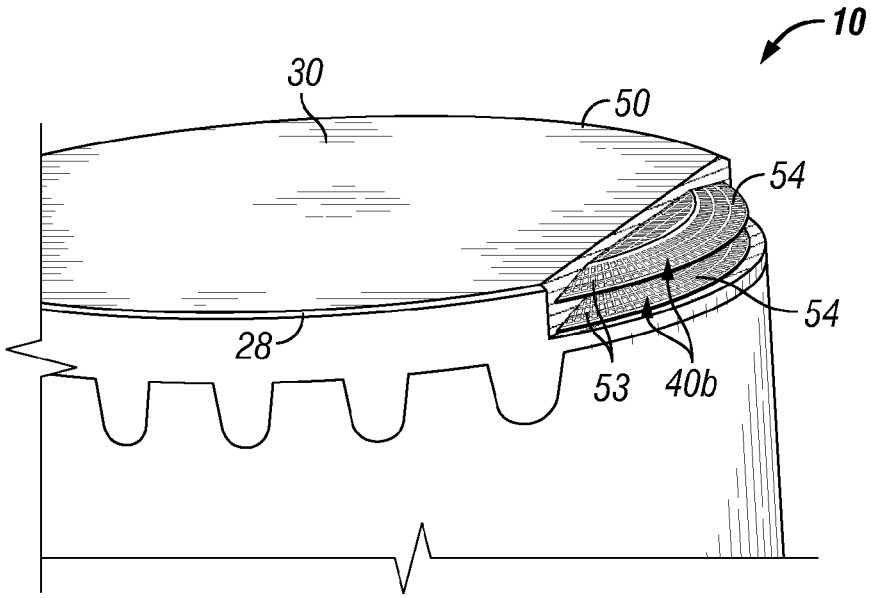
FIG. 5 is another is a partial cutaway perspective view of a PDC element having two discontinuities with a 'plate' configuration.

FIG. 4A is a top view of a discontinuity 40*b* formed as a particular tungsten carbide mesh pattern 54 crack arrestor in a 'perforated' configuration. The mesh pattern 54 is interrupted by areas 64 without mesh to allow diamond bonding around and through the mesh pattern 54 crack arrestor. These areas 64 without mesh may be formed around the embedded discontinuities 40*b* as shown in FIG. 5. The mesh pattern 54 is generally flat with a mesh periphery 57 which may be beveled or angled. It is contemplated that the tungsten carbide mesh pattern 54 may be extended to other geometries and sizes of PDC elements 10, as well.

FIG. 4B is a perspective view of a discontinuity 40*c* having particular 'snowflake' honeycomb pattern 72. The snowflake honeycomb pattern 72 has a flat base 73 with a skirt 75 extending therefrom at an angle. This flat base 73 of the discontinuity 40*c* has a flattened honeycomb portion that covers only a portion of the cross-section of a PDC element 10 (similar to the discontinuity 40*d* on cutting element 10 of FIG. 4C). The flat base 73 has a ring shape with a skirt 75 extending from portions of the flat base 73 to define the 'snowflake' configuration.

FIG. 4C is a perspective view of PDC element 10 having a discontinuity 40*d*. The discontinuity 40*d* has a particular mesh pattern 54' similar to the mesh pattern 54 of FIG. 4A. As shown in this 'plate' configuration, the mesh pattern 54' is without holes 64. It will be clear to those skilled in the art that FIG. 4C depicts the mesh pattern 54' positioned on a portion of the diamond table 22 that is below (and normally hidden by) the top surface 30 of the PDC element 10. The PDC element 10 has been worn such that portions of the diamond layer 22 have been removed along a fault plane weakness to reveal the mesh pattern 54' as the new top surface 30 and angled side surface 25. Before wear and removal of the diamond layer 22, the mesh pattern 54' may or may not extend to the outer cylindrical surface of the PDC element, hence may or may not be visible on its outer diameter until the diamond layer 22 is chipped away.

Figure 6:
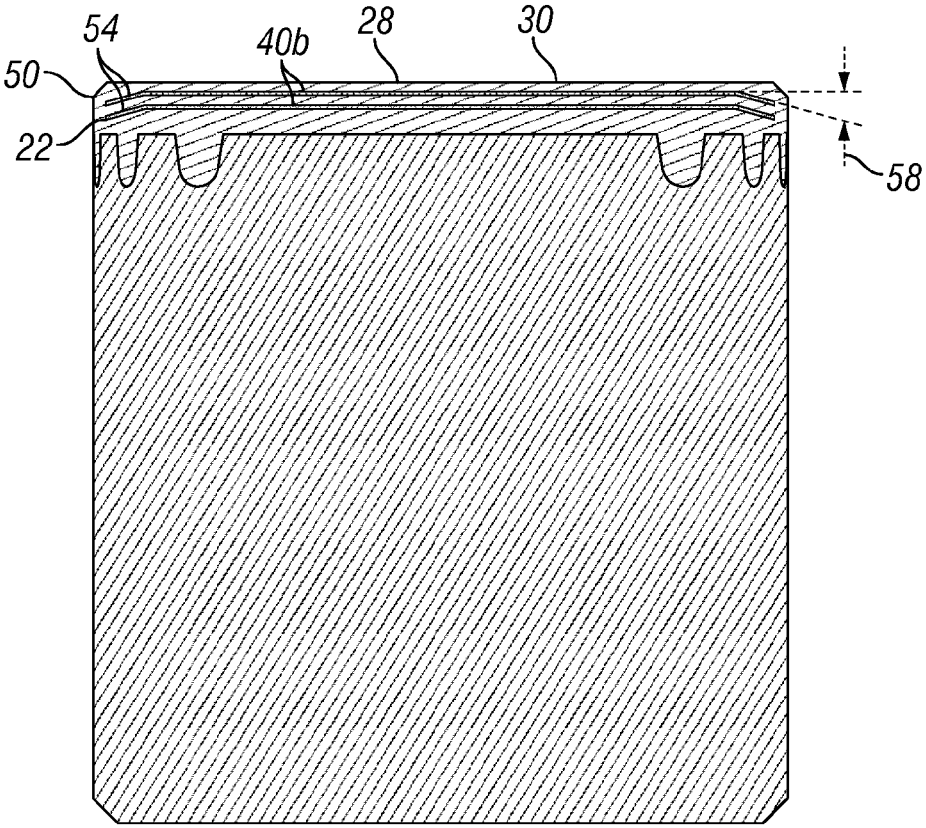
FIG. 6 is a cross-section view of the PDC element of FIG. 5.

Referring to FIGS. 5 and 6, A PDC element 10 with two 'fault plane' discontinuities 40*b* therein is depicted.

FIG. 5 is a partial cutaway perspective view of a PDC element 10 of FIG. 4C. The discontinuities 40*b* run substantially parallel to the top surface 30 of the PDC element 10 with each mesh pattern 54 having a bevel 57 adjacent the cutting edge 50 curving away at an angle 58 as shown in FIG. 6. The discontinuity 40*d* (as shown in FIG. 4C) may also be depicted by this same figure.

The induced 'fault plane' discontinuities (e.g, 40*b* or 40*d*) may be created by placing one or more of the layers of mesh pattern 54 within the mold with the preformed PDC element 10 prior to a high-pressure, high-temperature forming operation. The mesh pattern 54 may be tungsten carbide, or other suitable compound, and after the forming operation, the mesh may become integral with the PDC element 10. The 'fault plane' discontinuities 40*a*, 40*d* as illustrated in FIGS. 3 and 5 may not necessarily need to be aligned to be parallel to the end working surface 30. The other discontinuities described herein may be formed in a similar manner.

FIG. 6 shows a longitudinal cross-sectional view of the PDC element 10 of FIG. 5. This figure shows the two 'fault plane' mesh pattern discontinuities positioned in the diamond table 22. As shown in this view, the bevels 57 of the discontinuities extending away from the top surface 30 about the cutting edge 50 at an angle 58 as shown. This configuration defines an angle of chamfer upon fault lines which, when created, may be controlled by the angle 58 of the bevel 57.

The regular geometry of the discontinuities 40*a-d, a*' as described herein may be generated in operation, allowing preferential wear by creating non-planar fracture surfaces in the PDC element 10.

For example, as shown in FIGS. 5 and 6, the fracture surfaces may be defined along a periphery of the discontinuity 40*b* at the angle 58 of the discontinuity 40*b* at relative strengths or weaknesses.

Figure 7:
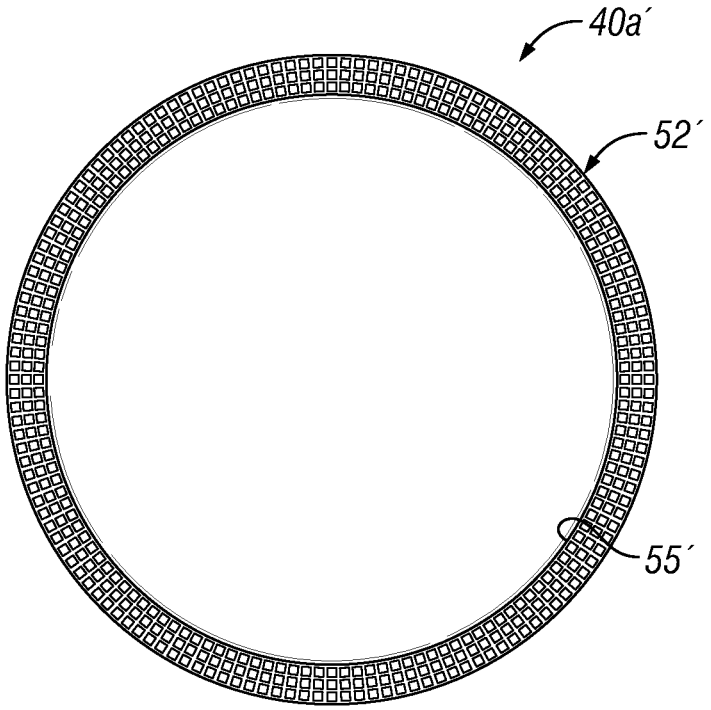
FIG. 7 is a top view of a discontinuity having a 'ring' configuration.
Figure 8:
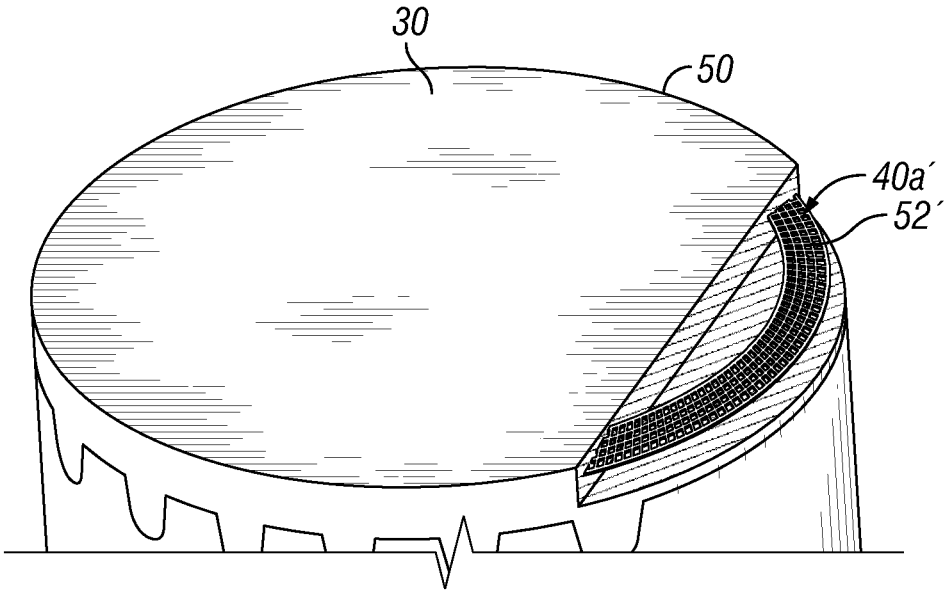
FIG. 8 is partial cutaway perspective view of a PDC element with the discontinuity of FIG. 7 therein at an angle to a top surface of the PDC element.

FIG. 7 shows a top view of the discontinuity 40*a*' of FIG. 3 having a mesh pattern 52' in a ring configuration with a hole 55' therethrough. The mesh pattern 52' is extended throughout an entire periphery (but not in the center) of the discontinuity 40*a*'. The discontinuity 40*a*' may have a mesh pattern 52' that is similar to the mesh pattern 52 of FIG. 4A. One or more of the discontinuities 40*a*' or 40*a* may be positioned in a PDC element 10 as shown, for example, in FIGS. 3 and 8. FIG. 8 is similar to FIG. 3, but shows only one discontinuity 40*a*' therein, and is at an angle to the top surface 30.

Many different types of mesh patterns may be extended to other geometries and sizes of these parts, and is not limited to a solid mesh. For example, the mesh patterns of the discontinuities herein may also be formed into shapes such as a mesh pattern 52' (as shown in FIG. 7) or other patterns. Additional shapes of the induced stress planes may be specifically engineered as necessary for the desired performance.

The figures herein disclose a preform PDC element 10 suitable for use in earth boring drill bits having a feature of regular geometry (such as a honeycomb, or sieve) made with a tungsten carbide (or other compatible material) embedded in the diamond table. The embedded discontinuities 40*a-d, a*' may be introduced at strategic locations about the cutting edge 50 of the PDC element 10 for use in earth boring drill bits.

These embedded discontinuities 40*a-d, a*' may act to diffuse stress concentration at the cusp of a forming crack and prevent or slow its propagation.

As a result, this may thereby limit damage to the diamond table 22 due to overload or impact, and may also reduce the instances of or at least minimize the effects of catastrophic failure. In essence, the discontinuities 40*a-d,a*' may act as crack arrestors. The discontinuities 40*a-d*, a' may be sintered together with the polycrystalline diamond grit and the tungsten carbide substrate under conditions of ultra high temperatures and pressures, as is well known.

The PDC element configuration may be adjusted to optimize the formation of new cutting edges during operation. The PDC element 10 may be provided with higher abrasion resistance (i.e. more competent or hard) to prevent the PDC element from wearing quickly and easily in service, or dulling the cutting edge sooner than desired. Efforts to improve the inherent abrasion resistance of the PDC element may revolve around improved sintering (diamond to diamond bonding) and/or leaching the catalyzing material out of the mesh pattern of the PDC element adjacent to the working surfaces. The inherent abrasion resistance of the PDC element may be increased by using finer diamond particles. The selected diamond particles may be selected to avoid compromising other physical properties, such as the impact resistance of the edge, with the diamond crumbling away in service. While it may be desirable, from the abrasion resistance and integrity of the PDC element point of view, to improve sintering and diamond to diamond bonding, it may also be useful to ensure that the edge is chipped or broken away in a controlled manner with as small as possible chips when in operation.

As the figures also show, the discontinuities herein may reside close to the cutting edge 50, and follow the edge geometry of the preform PDC element 10, but they may also run along other surfaces. While in operation, the discontinuity may not wear initially, but may be exposed upon wear or impact damage of the surrounding areas during operation.

An exposed discontinuity 40*a-d, a*' may wear or chip away quickly to expose a controlled geometry diamond cutting edge 50, allowing controlled the loss of the diamond table 22 on subsequent impacts.

As shown, for example, in FIG. 6, the fault place weakness of the PDC element 10 may be controlled by the bevel angle 58 of the peripheral cutting edge working surface 28 set by the mesh pattern 54, and may be adjusted with the addition of multiple mesh patterns 54.

The PDC element cutting 10 may be a polycrystalline diamond PDC element 10 with a diamond table 22 integrally formed with a tungsten carbide substrate. The diamond table 22 may be provided with one or more discontinuities 40*a-d, a*' formed from non-diamond materials along the cutting edge 50 that, as described above, continuously create and refresh a fracture surface in the diamond table 22 while in operation by continuously exposing a sharp cutting edge to the formation material being cut. Suitable non-diamond materials for the discontinuities 40*a-d*, a' may include a generally circular titanium 'mesh' product and formed with and without the center portion of the mesh pattern. In one example, a non-diamond material for the discontinuity 40*a* may be a perforated tungsten carbide mesh material formed in the geometrical shape of a disk. Another preferred embodiment may be a mesh of discontinuities 40*a* made of perforated tungsten carbide disc and formed into a 'bellville washer' like shape as shown in FIG. 4A but having a very large (over 70%) open space, wherein the mesh 40*a-d, a*' is from about 55% to about 65%, and preferably about 61% open.

The mesh geometry and material and processing may also be varied to adjust for the thickness of the PDC element 10, (for disc or separation) and the percentage of the open space. In addition, it may be possible to reduce manufacturing time in sintering and, therefore, yield a sintered product with an increased amount of cobalt now available from the additional tungsten carbide available within the diamond table to make these PDC elements 10.

Furthermore, there may be a residual stress reduction in the finished PDC element 10 due to the layering associated with the mesh 40*a-d, a*' geometry. Additionally, this layering may not be in contact with the formation initially, but may be exposed upon wear or impact damage of the outer surface. It may wear or chip away quickly or slowly as may be desired to expose a controlled geometry diamond cutting edge 50, thereby controlling the loss of the diamond table 22 from the impacts.

Alternately the PDC element 10 of the present invention may incorporate the use of scattered pellets or fibers of suitable materials, such as aggregated carbon nano-rods 25 shown in FIG. 4C, (also known as ACNR), that may not interfere with the quality of the final sintered diamond product. These features may displace some of the diamond material at the cutting edge 50, and because the discontinuity material is less hard than the diamond material, it may 'wear' into providing a cutting edge similar to that as described above. In addition, the diamond grit composition may be adjusted at the cutting edge 50 in order to allow for a selective reduction in abrasion resistance (with an accompanying increase in impact strength) adjacent to the cutting edge 50 to help control the rate of chipping at the cutting edge.

The introduction of discontinuities 40*a-d, a'* along planes parallel to the top surface 30 or angle 58 of chamfer (or alternately the edge preparation angle) some distance into the diamond table 22 may allow the cutting edge 50 of the diamond table 22 to flake off when worn to a certain depth, thus exposing a fresh cutting edge 50 with an induced edge geometry to contact the formation. This may be accomplished without excessive loss of the diamond material.

While the present disclosure describes specific aspects of the invention, numerous modifications and variations will become apparent to those skilled in the art after studying the disclosure, including use of equivalent functional and/or structural substitutes for elements described herein. For example, one or more discontinuities of various shapes may be implemented in one or more PDC elements 10. All such similar variations apparent to those skilled in the art are deemed to be within the scope of the invention as defined by the appended claims.

Plural instances may be provided for components, operations, or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

Whereas the present invention has been described in particular relation to the drawings attached hereto, it should be understood that other and further modifications apart from those shown or suggested herein, may be made within the scope and spirit of the present invention.

What is claimed is:

1. A polycrystalline diamond cutting element of a drill bit of a downhole drilling tool, comprising:

a substrate;

a diamond table positionable on the substrate, the diamond table having an end working surface and a periphery, an initial cutting edge formed between the end working surface and the periphery; and at least one structural pattern embedded within the diamond table, the at least one structural pattern formed of a continuous non-diamond structure extending around and spaced inwardly from the periphery, the at least one structural pattern defining at least one discontinuity about the diamond table that, in operation, selectively breaks away upon impact to create new cutting edges in the diamond table whereby a sharp cutting edge is continuously exposed to a material being cut.

2. The polycrystalline diamond cutting element of claim 1, wherein the discontinuity is formed along the initial cutting edge within the diamond table react to operating loads to direct shearing forces into the diamond table to fracture the initial cutting edge and to form the new cutting edges.

3. The polycrystalline diamond cutting element of claim 1, wherein the at least one pattern comprises a mesh pattern.

4. The polycrystalline diamond cutting element of claim 1, wherein the at least one pattern comprises a honeycomb pattern.

5. The polycrystalline diamond cutting element of claim 1, wherein the at least one pattern is sintered together with the diamond table and the substrate under conditions of ultra high temperatures and pressures.

6. The polycrystalline diamond cutting element of claim 1, wherein the diamond table comprises a polycrystalline diamond grit.

7. The polycrystalline diamond cutting element of claim 1, wherein the substrate comprises a tungsten carbide substrate.

8. The polycrystalline diamond cutting element of claim 1, wherein the at least one discontinuity defines a fracture surface along the initial cutting edge.

9. The polycrystalline diamond cutting element of claim 1 wherein the at least one discontinuity resides close to the initial cutting edge and follows an edge geometry of the diamond table.

10. The polycrystalline diamond cutting element of claim 1, wherein the diamond table wears over time such that the at least one pattern is exposed upon wear and/or impact damage to the initial cutting edge of the diamond table.

11. The polycrystalline diamond cutting element of claim 1, wherein the diamond table wears quickly such that the at least one pattern wears away quickly to expose a controlled geometry of the new cutting edges, thereby reducing loss of the diamond table on subsequent impacts.

12. The polycrystalline diamond cutting element of claim 1, wherein the at least one pattern has one of a snowflake configuration, a ring configuration, a plate configuration, a perforated configuration and combinations thereof.

13. The polycrystalline diamond cutting element of claim 1, wherein the at least one pattern comprises a plurality of patterns, each of the plurality of patterns defining an additional discontinuity parallel to a top surface of the diamond table.

14. The polycrystalline diamond cutting element of claim 1, wherein the at least one pattern has an angled periphery positionable about the cutting edge.

15. The polycrystalline diamond cutting element of claim 1, wherein the at least one pattern comprises tungsten carbide.

16. The polycrystalline diamond cutting element of claim 1, wherein the at least one structural patter comprises scattered pellets of aggregated carbon nano-rods.

17. A polycrystalline diamond cutting element of a drill bit of a downhole drilling tool, comprising:

a substrate;

a diamond table positionable on the substrate, the diamond table having an end working surface and a periphery, an initial cutting edge formed between the end working surface and the periphery; and at least one structural pattern embedded within the diamond table, the at least one structural pattern formed of a continuous non-diamond structure extending around and spaced inwardly from the periphery, the at least one structural pattern comprising at least one discontinuity defining a plane of weakness within the diamond table that, in operation, selectively breaks away along the plane of weakness to continuously expose fracture surfaces in the diamond table whereby a sharp cutting edge is continuously exposed to a material being cut.

18. The polycrystalline diamond cutting element of claim 17, wherein the at least one discontinuity along the initial cutting edge creates a fracture surface which allows exposure of a new cutting edge to the material being cut.

19. The polycrystalline diamond cutting element of claim 17, wherein the at least one pattern has a periphery defining an angle of a chamfer that creates a fault line in the diamond table which is controlled by an angle of a mesh of the at least one pattern.

20. A method of drilling with a downhole drilling tool having a drill bit, comprising:

positioning a plurality of polycrystalline diamond cutting elements on the drill bit, each of the plurality of polycrystalline diamond cutting elements comprising:

a substrate;

a diamond table positionable on the substrate, the diamond table having an end working surface and a periphery, an initial cutting edge formed between the end working surface and the periphery; and at least one pattern integrally formed within the diamond table, the at least one structural pattern embedded within the diamond table, the at least one structural pattern formed of a continuous non-diamond structure extending around and spaced inwardly from the periphery and defining at least one discontinuity about the diamond table;

continuously exposing a sharp cutting edge by selectively breaking away portions of the diamond table upon impact to create a new cutting edge in the diamond table as the drill bit is advanced into the earth.

* * * * *